US011547915B1

(12) United States Patent
Reynolds

(10) Patent No.: US 11,547,915 B1
(45) Date of Patent: Jan. 10, 2023

(54) CORNHOLE TRAINING APPARATUS

(71) Applicant: Jeffrey Almon Reynolds, Garrettsville, OH (US)

(72) Inventor: Jeffrey Almon Reynolds, Garrettsville, OH (US)

( * ) Notice: Subject to any disclaimer, the term of this patent is extended or adjusted under 35 U.S.C. 154(b) by 0 days.

(21) Appl. No.: 17/377,939

(22) Filed: Jul. 16, 2021

(51) Int. Cl.
*A63B 67/06* (2006.01)
*A63B 69/00* (2006.01)

(52) U.S. Cl.
CPC ..... *A63B 69/00* (2013.01); *A63B 67/06* (2013.01); *A63B 2209/08* (2013.01); *A63B 2209/10* (2013.01)

(58) Field of Classification Search
CPC ... A63B 67/06; A63B 69/00; A63F 2007/301; A63F 2007/3005
See application file for complete search history.

(56) References Cited

U.S. PATENT DOCUMENTS

| | | | | |
|---|---|---|---|---|
| 4,074,373 | A * | 2/1978 | Garofalo | A61B 6/04 378/204 |
| 9,451,801 | B2 * | 9/2016 | Bryan | A42B 3/044 |
| D944,328 | S * | 2/2022 | Spady | D21/303 |
| 2014/0150803 | A1 * | 6/2014 | Gold | A61G 99/00 128/845 |
| 2020/0406114 | A1 * | 12/2020 | Spady | A63B 63/08 |
| 2021/0146210 | A1 * | 5/2021 | Roberts, Jr. | A63B 67/06 |

FOREIGN PATENT DOCUMENTS

| | | | | |
|---|---|---|---|---|
| DE | 202013002113 U1 * | 7/2013 | ..... | A63F 3/00574 |

OTHER PUBLICATIONS

Ultra Cornhole, Trainer Pro, https://ultracornhole.com/product/ultra-trainer-pro/, archived by the Internet Archive on Jun. 20, 2019 (Year: 2019).*
Native Cornhole, Airmail 5000, https://www.facebook.com/nativecornhole/videos/airmail5000-httpsnativecornholecomproductsairmail-5000_pos1_sid110fef0da_ssr/1864358313697235/, posted on Feb. 27, 2020 (Year: 2020).*
English machine translation of DE 202013002113 U1 (Year: 2013).*

* cited by examiner

*Primary Examiner* — Laura Davison
(74) *Attorney, Agent, or Firm* — Brennan, Manna & Diamond, LLC

(57) ABSTRACT

A cornhole training apparatus for simulating practice scenarios involving a blocking bag positional near a hole on a cornhole game board. The cornhole training apparatus comprises a blocking bag mounting structure configured to engage the cornhole gameboard surface. The blocking bag mounting structure comprises a horizontal band and a pair of cornhole board engaging members. The pair of cornhole board engaging members are oppositely disposed at either end of the horizontal band and configured to extend around and engage the sides of the cornhole gameboard to hold the blocking bag mounting structure in place. A blocking bag is attachable to the horizontal band to simulate a cornhole bag obstructing the hole.

17 Claims, 7 Drawing Sheets

CORNHOLE TRAINING APPARATUS

FIELD OF THE INVENTION

The present invention generally relates to a training aid for a bag toss game, and more specifically to a cornhole training apparatus for improving cornhole game play skills. Accordingly, the present specification makes specific reference thereto. However, it is to be appreciated that aspects of the present invention are also equally amenable to other like applications, devices, and methods of manufacture.

BACKGROUND

Cornhole is a lawn game where players take turns throwing sixteen ounce bags at an inclined slanted wooden platform. The game targeting structure or platform, known as a board, has a circular aperture near the far end of the board for receiving a successfully tossed bag. A bag tossed into the hole is credited with three points, while a bag that lands and stays on the board surface the board is awarded one point. The game is won when a team or player reaches or exceeds a score of twenty-one by means of cancellation scoring. In cancellation scoring, the points of one player or team cancel out the points of their opponent. Cancellation scoring allows only one player or team to score in each inning.

Each set of bags consist of four bags which are distinguishable from the other, typically by color. Although bags were originally filled with corn kernels giving the game its name, bags are now typically filled with a plastic resin or similar granular material to maintain a consistent weight and shape. The bags are approximately six inch by six inch fabric covered bags weighing between approximately 15.5 to 16.5 ounces.

Each board is approximately two feet wide and four feet long with a six inch hole centered nine inches from the top of the board. Each board is angled or inclined so that the top edge of the board playing surface is elevated by a pair of legs twelve inches above the ground. The foot of the board rests on the ground with the bottom edge of the board playing surface between three and four inches above the ground. Two boards are placed so that the bottom edges of the boards are approximately twenty seven feet apart, with the holes separated by approximately thirty three feet which forms a court. Bags are tossed from a rectangular area directly to the left or right of a board without a player stepping past the bottom of the board during a toss.

Cornhole matches are broken down into frames of play known as innings. Each player tosses or pitches four bags, alternating teams between each throw to complete an inning. A player must deliver the bag from either the left or right rectangular area directly to the left or right of a board known as a pitcher's box without stepping outside of the box. Opponents never throw from the same pitcher's box during a frame.

A bag must either be tossed through the hole or land on the board to score points. The bags can be tossed directly into the hole, slide into the hole after hitting the board, or be knocked into the hole by another bag on a different toss. Bags touching the ground before landing on the board are removed from the board prior to continuation of play and not worth any points. Scoring is done by cancellation (e.g., if one player scores six points in the frame and the other player scores four points in the same frame, the first player receives two points). The game ends when a player or team reaches or exceeds twenty one points.

The game has become very popular and competitive. Gameplay strategy varies by player and skill level. It is not uncommon for professional players to slide all of their bags into the hole if no bag blocks the path in each inning. Defensive strategies have been developed to slow down game play or force opponents to make tactical decisions. One common defensive strategy employs using a blocking bag. The player throws a bag to intentionally rest in front of the hole instead of scoring. This forces an opponent to attempt to either slide through the blocker bag into the hole, throw another blocker behind the first blocker bag, or attempt a riskier "airmail" shot over the blocker bag (throwing directly through the hole without first touching the board). The airmail shot is typically more difficult to achieve than a sliding shot.

Accordingly, there is a great need for a way for cornhole players to improve their playing skills. There is also a need for a way for teach players how to deal with a blocking bag. Similarly, there is a need for a training tool that replicates a blocking bag in place on a cornhole board. Further, there is a need for an adjustable training aid to simulate scenarios where blocking bags are placed at different positions on a cornhole board.

In this manner, the improved system of the present invention accomplishes all of the foregoing objectives, thereby providing an easy solution for improving cornhole playing skills. A primary feature of the present invention is a training apparatus for use with a cornhole board. The present invention allows a user to replicate a scenario where a blocking bag is in place on a cornhole board in front of the hole. Finally, the improved training apparatus of the present invention is capable of allowing a player to simulate different blocking bag scenarios to improve their cornhole skills and create a practice platform for airmail type shots.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a cornhole training apparatus. The cornhole training apparatus is adapted for use with a cornhole gameboard. The cornhole training apparatus spans a portion of a top surface and extends around the sides of a cornhole gameboard when in position. The cornhole training apparatus may be placed just below the circular aperture of the cornhole gameboard to help train users in how to avoid a blocking bag.

The cornhole training apparatus comprises a blocking bag mounting structure. The blocking bag mounting structure comprises a horizontal band and a pair of cornhole board engaging members. The pair of cornhole board engaging members are oppositely disposed at either end of the horizontal band. The pair of cornhole board engaging members extend generally downward from each respective end of the horizontal band and are generally flexible. The pair of cornhole board engaging members are configured to frictionally engage the sides of the cornhole gameboard to position and secure the horizontal band in place on the top surface of the cornhole gameboard.

Each cornhole board engaging member comprises a side grip portion. Each side grip portion extends downward from the respective end parallel to the side of the cornhole gameboard when in place. Each cornhole board engaging member may further comprise an underside grip portion. Each underside grip portion extends inward from the respective side grip portion and may angle up around the backside of the side of the cornhole gameboard when in place. The cornhole training apparatus may be positioned by sliding up or down the cornhole gameboard or the pair of cornhole board engaging members may be spread apart to fit around the sides before contracting back and conforming to the gameboard.

The horizontal band comprises a top side and a bottom side that rests against the top surface of the cornhole gameboard when in place. A blocking bag attachment position is centered on the horizontal band between the pair of cornhole board engaging members generally in front of the circular aperture in the cornhole gameboard when in place. Alternatively, the blocking bag attachment position may be located anywhere along the horizontal band.

The blocking bag mounting structure further comprises a blocking bag attachment element. The blocking bag attachment element is attachable to the top side of the horizontal band at the blocking bag attachment position. The cornhole training apparatus may further comprise a plurality of blocking bag attachment elements positional at various locations on the horizontal band. Each blocking bag attachment element comprises a horizontal band attachment portion and a blocking bag engaging portion.

The cornhole training apparatus may further comprise at least one blocking bag. The at least one blocking bag is attachable to the horizontal band of the blocking bag mounting structure. The cornhole training apparatus may further comprise a plurality of blocking bags. Each blocking bag comprises a cornhole bag and a mounting structure engaging component. The mounting structure engaging component is attached to the cornhole bag via a blocking bag attachment portion. The mounting structure engaging component comprises a mounting structure engaging portion for attaching the blocking bag to the blocking bag attachment element of the blocking bag mounting structure.

The blocking bag attachment element may be permanently fixed to or re-positional along the horizontal band. In one embodiment, the horizontal band may further comprise a magnetic element. The magnetic element may be used to attract and hold in place the mounting structure engaging portion of the at least one blocking bag. In another embodiment, the horizontal band may further comprise a channel. The channel is a small groove horizontally disposed in the top surface of the horizontal band. The channel is configured to accept the mounting structure engaging portion of the at least one blocking bag allowing the blocking bag to slide to different positions.

In another embodiment, the blocking bag mounting structure may further comprise a vertical structure. The vertical structure extends perpendicularly from the horizontal band. The vertical structure comprises a first vertical extension. The first vertical extension extends upward from the horizontal band on one side of the circular aperture of the cornhole board. One of the plurality of blocking bag attachment elements may be attached to the first vertical extension to position one of the blocking bags next to the circular aperture. The vertical structure may comprise a second vertical extension. The second vertical extension may extends upward from the horizontal band on the opposite side of the circular aperture of the cornhole board from the first vertical extension. One of the plurality of blocking bag attachment elements may be attached to the second vertical extension to position one of the blocking bags next to the circular aperture.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
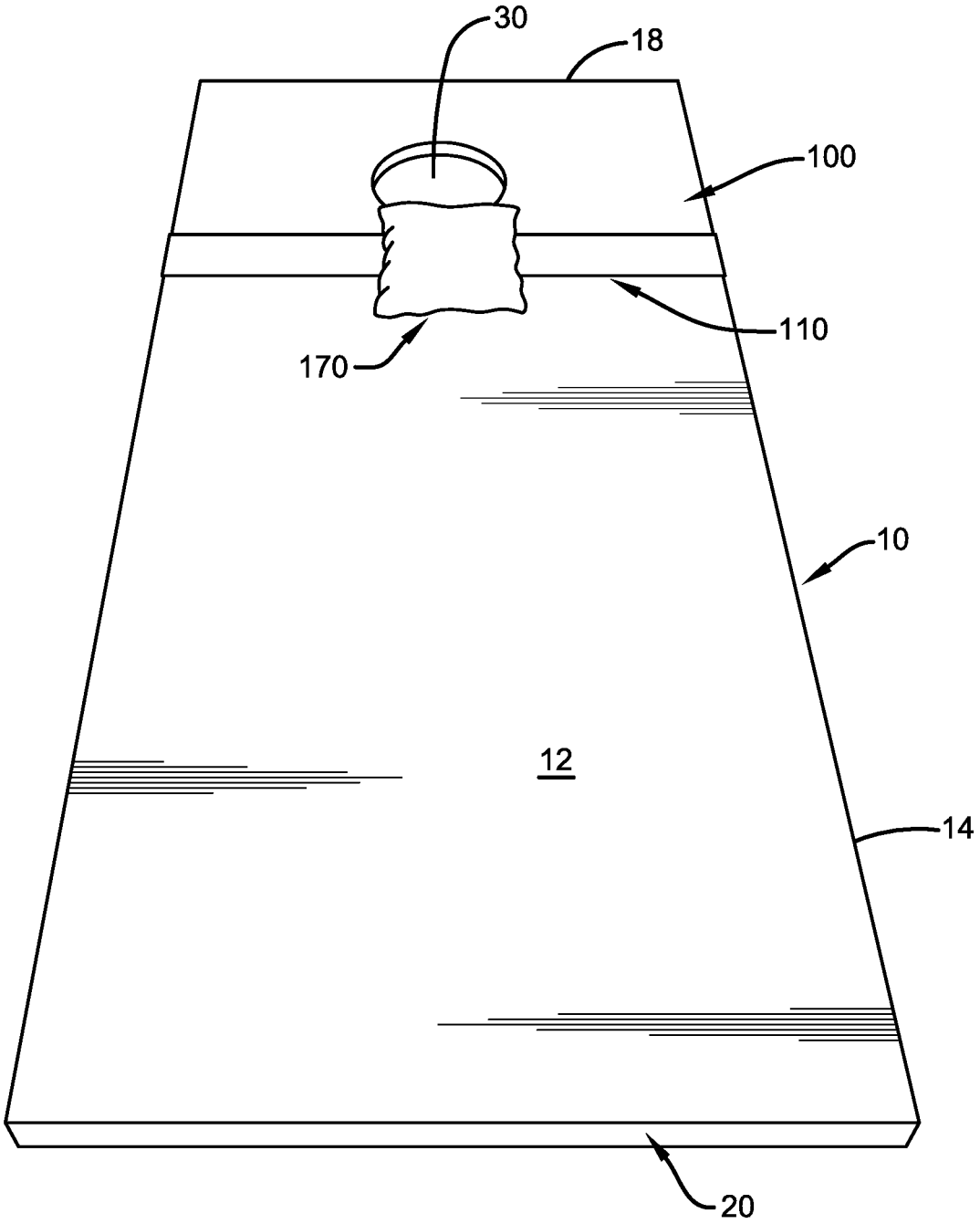
FIG. 1 illustrates an overhead perspective view of a cornhole training apparatus of the present invention in place on a cornhole gameboard in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

Referring initially to the drawings, FIGS. 1-12 illustrate a cornhole training apparatus 100. The cornhole training apparatus 100 is adapted for use with any standard cornhole gameboard 10 as illustrated in FIG. 1. The cornhole training apparatus 100 is configured to horizontally span a portion of a top surface 12 and extend around the sides 14 to the bottom 16 of the cornhole gameboard 10. The cornhole training apparatus 100 may be positioned just below a circular aperture 30 of the cornhole gameboard 10 to train users in how to avoid a blocking bag 170 positioned in front of or near the circular aperture 30. The cornhole training apparatus 100 is movable up and down a length of the cornhole gameboard 10 between a head 18 and a foot 20 of the cornhole gameboard 10 to allow the user to practice airmail and roll shots.

Figure 2:
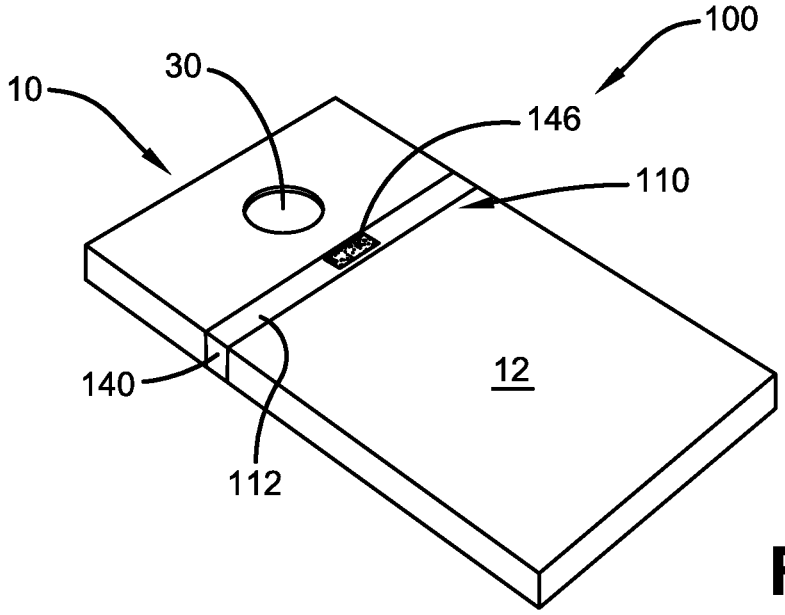
FIG. 2 illustrates a top perspective view of the cornhole training apparatus of the present invention in place on a cornhole gameboard in accordance with the disclosed architecture.
Figure 6:
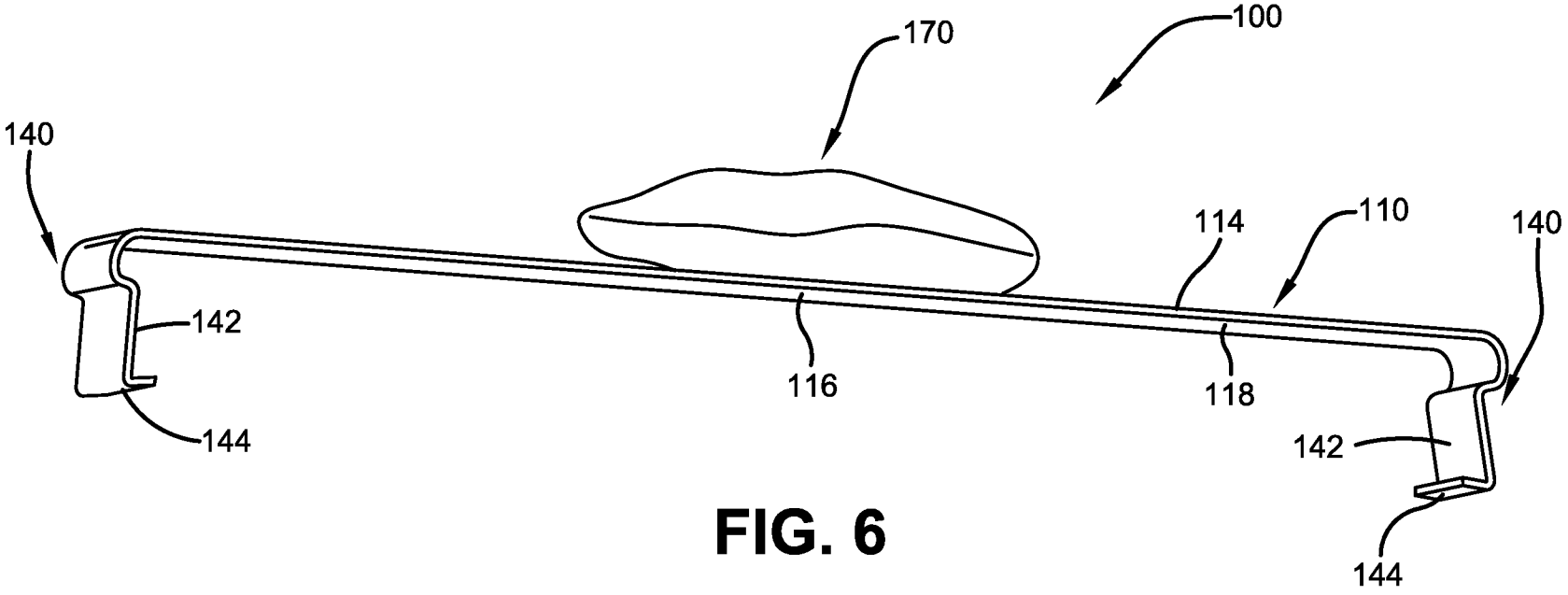
FIG. 6 illustrates a side perspective view of the cornhole training apparatus of the present invention in accordance with the disclosed architecture.

As illustrated in FIGS. 2 and 6, the cornhole training apparatus 100 comprises a blocking bag mounting structure 110. The blocking bag mounting structure 110 is generally constructed from a thin flexible material, such as plastic and is formed to fit around the cornhole board 10. The blocking bag mounting structure 110 comprises a horizontal band 112 and a pair of cornhole board engaging members 140. The horizontal band 110 is typically approximately between one and three inches wide but may be wider or narrower as desired. The horizontal band 110 comprises a top side 114 and a bottom side 118 positional against the top surface 12 of the cornhole gameboard 10 when in place. The top side 114 typically has a similar coefficient of friction as the top surface 12 of the cornhole gameboard 10 so that bags will easily slide across the horizontal band 110.

The pair of cornhole board engaging members 140 are oppositely disposed at either end of the horizontal band 112. The pair of cornhole board engaging members 140 extend generally downward from each respective end of the horizontal band 112 and are generally flexible. The pair of cornhole board engaging members 112 are configured to frictionally engage the sides 14 of the cornhole gameboard 10 to position and secure or hold the horizontal band 112 in place on the top surface 12 of the cornhole gameboard 10.

Figure 3:
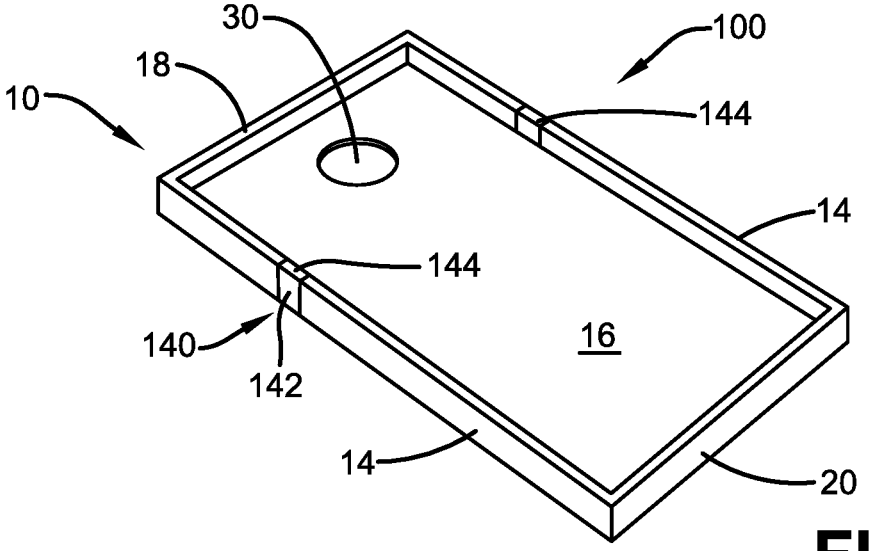
FIG. 3 illustrates an underneath perspective view of the cornhole training apparatus of the present invention in place on a cornhole gameboard in accordance with the disclosed architecture.
Figure 7:
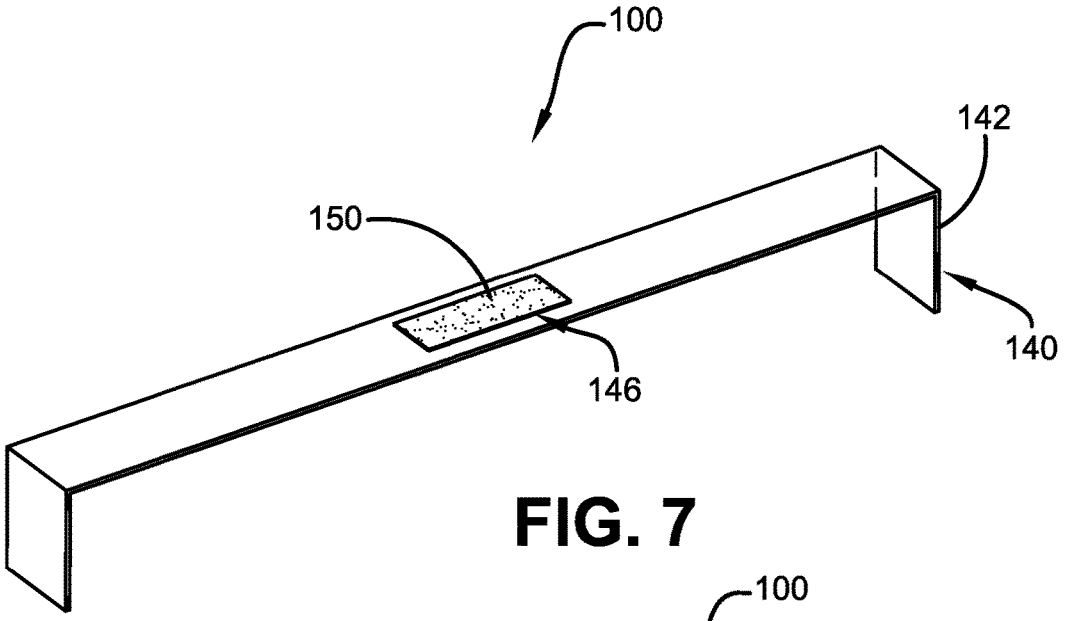
FIG. 7 illustrates a perspective view of a blocking bag mounting structure of the cornhole training apparatus of the present invention in accordance with the disclosed architecture.

Each cornhole board engaging member 140 comprises a side grip portion 142. Each side grip portion 142 extends generally perpendicularly downward from the respective end of the horizontal band 112 parallel to the respective side 14 of the cornhole gameboard 10 when in place as illustrated in FIGS. 2 and 7. Each cornhole board engaging member 140 may further comprise an underside grip portion 144. Each underside grip portion 144 extends generally perpendicularly inward out of the respective side grip portion 142. Each underside grip portion 144 may then angle up around the respective side 12 to the backside 16 of the cornhole gameboard 10 when in place as illustrated in FIGS. 3 and 8.

The cornhole training apparatus 100 may be positioned on the cornhole gameboard 10 by sliding up or down the cornhole gameboard 10 from the head 18 or foot 20. Alternatively, the pair of cornhole board engaging members 140 may be spread or pulled apart to fit around the sides 14 before contracting back and conforming to the gameboard 10. When in place, friction generally keeps the cornhole training apparatus 100 from moving.

Figure 8:
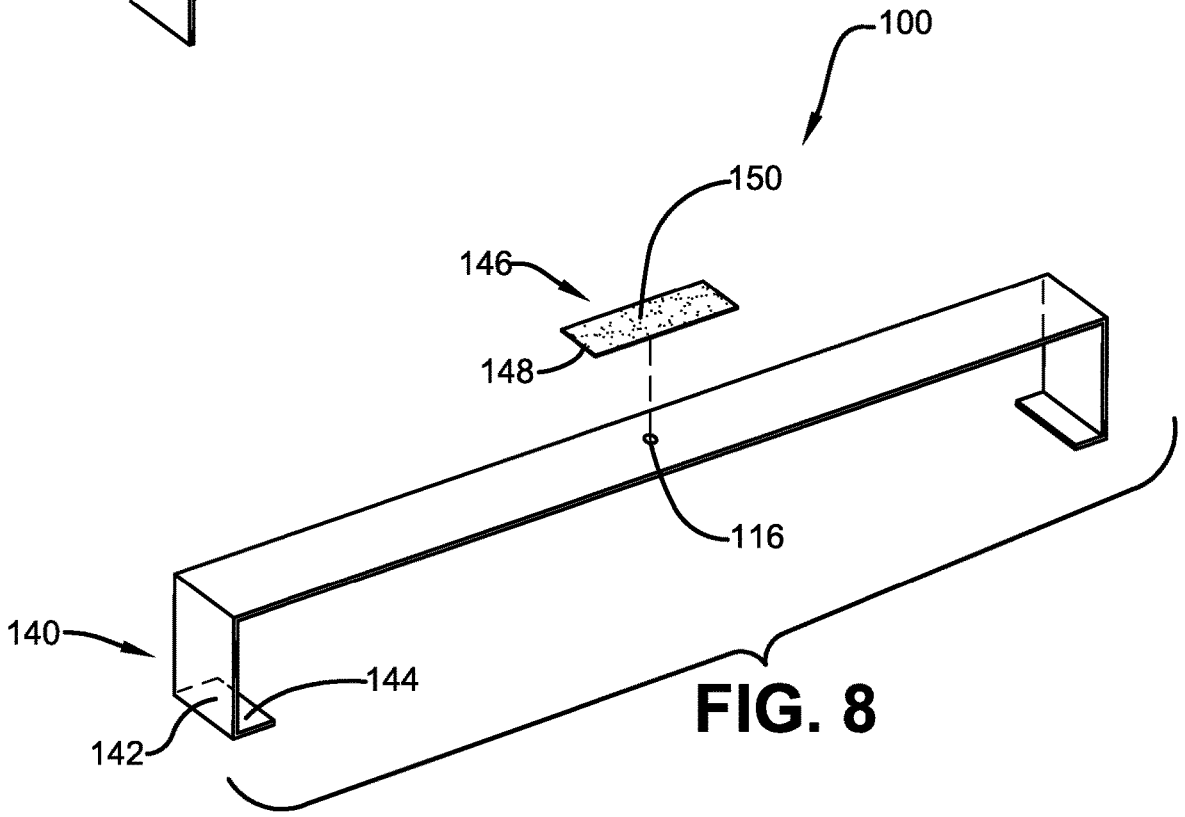
FIG. 8 illustrates a perspective view of the blocking bag mounting structure of the cornhole training apparatus of the present invention in accordance with the disclosed architecture.

As illustrated in FIG. 8, a blocking bag attachment position 116 is centered on the horizontal band 112 between the pair of cornhole board engaging members 140 generally in front of the circular aperture 30 in the cornhole gameboard 10 when in place. This is advantageous as it recreates and simulates a practice scenario requiring an airmail type bag toss to score. Alternatively, the blocking bag attachment position 116 may be located anywhere along the horizontal band 112.

As illustrated in FIGS. 2, 7, and 8, the blocking bag mounting structure 110 further comprises a blocking bag attachment element 146. The blocking bag attachment element 146 is attachable to the top side 114 of the horizontal band 112 at the blocking bag attachment position 116. The cornhole training apparatus 110 may further comprise a plurality of blocking bag attachment elements 146 positional at various locations on the horizontal band 112. Each blocking bag attachment element 146 comprises a horizontal band attachment portion 148 and a blocking bag engaging portion 150. The horizontal band attachment portion 148 may attach to the horizontal band 112 with an adhesive or a mechanical fastener. The blocking bag engaging portion 150 may be a hook and loop fastening system or other similar temporary attachment mechanism.

Figure 4:
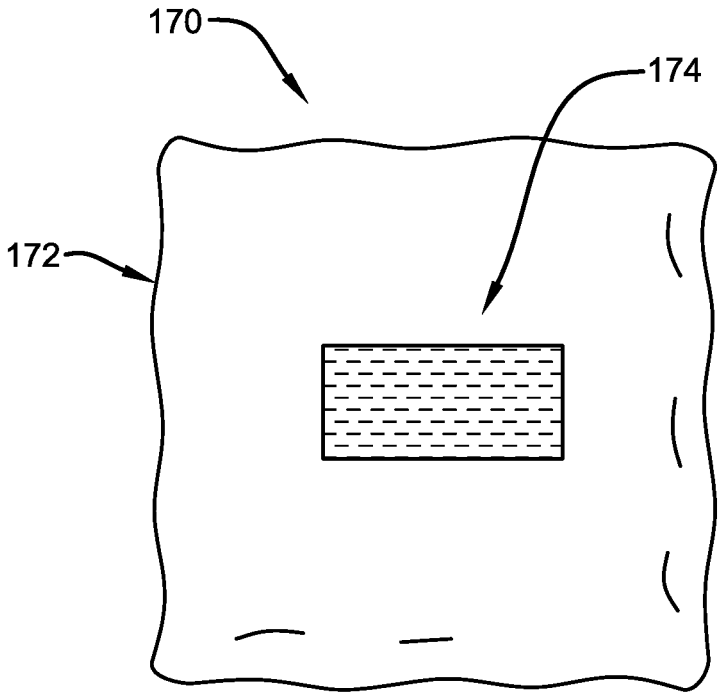
FIG. 4 illustrates a bottom view of a blocking bag of the cornhole training apparatus of the present invention in accordance with the disclosed architecture.
Figure 5:
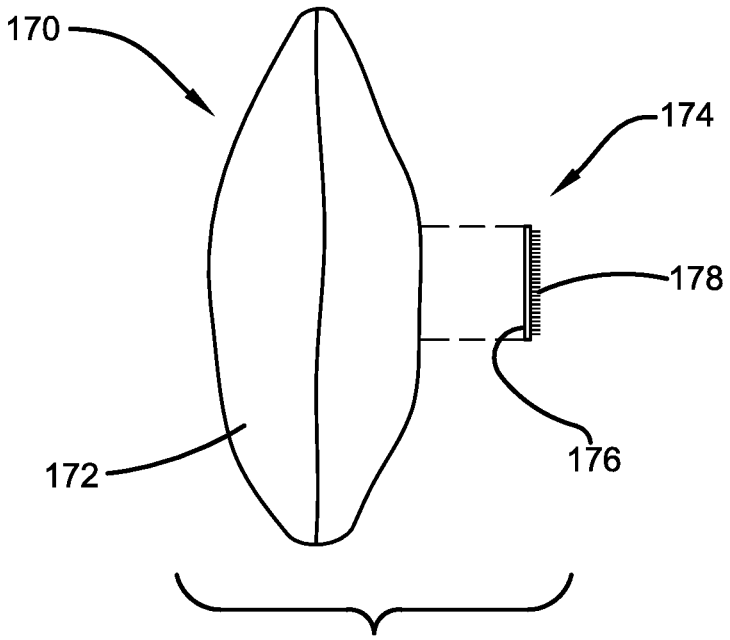
FIG. 5 illustrates an exploded side view of blocking bag the cornhole training apparatus of the present invention in accordance with the disclosed architecture.

As illustrated in FIGS. 4 and 5, the cornhole training apparatus 100 may further comprise at least one blocking bag 170. The at least one blocking bag 170 is attachable to the horizontal band 112 of the blocking bag mounting structure 110. The cornhole training apparatus 100 may further comprise a plurality of blocking bags 170. Each blocking bag 170 comprises a typical cornhole bag 172 and a mounting structure engaging component 174. The mounting structure engaging component 174 is attached to the cornhole bag 172 via a blocking bag attachment portion 176. The mounting structure engaging component 174 is attached to the bag 172 by adhesive or a mechanical fastener, such as thread. Alternatively, the cornhole training apparatus 100 may comprise a mounting structure engaging component 174 without the blocking bag 170 for attachment to a regular cornhole bag.

The mounting structure engaging component 174 comprises a mounting structure engaging portion 178. The mounting structure engaging portion 178 is used to temporarily attach the blocking bag 170 to the blocking bag attachment element 146 of the blocking bag mounting structure 110. The mounting structure engaging portion 178 may be a hook and loop fastening system, other temporary attachment mechanism, or a magnetic element configured to releasably mate with the blocking bag engaging portion 150.

The blocking bag attachment element 146 may be permanently fixed or re-positional along the horizontal band 112. In one embodiment illustrated in FIGS. 10 and 11, the horizontal band 112 may further comprise a magnetic element 120. The magnetic element 120 may be a magnetic strip or spot attached to the bottom side 118 or embedded within the horizontal band 112. The magnetic element 120 is used to attract and hold in place a magnetic version of the mounting structure engaging portion 178 of the at least one blocking bag 170. The magnetic element 120 may be used in conjunction with or independently of the blocking bag attachment element 146.

Figure 9:
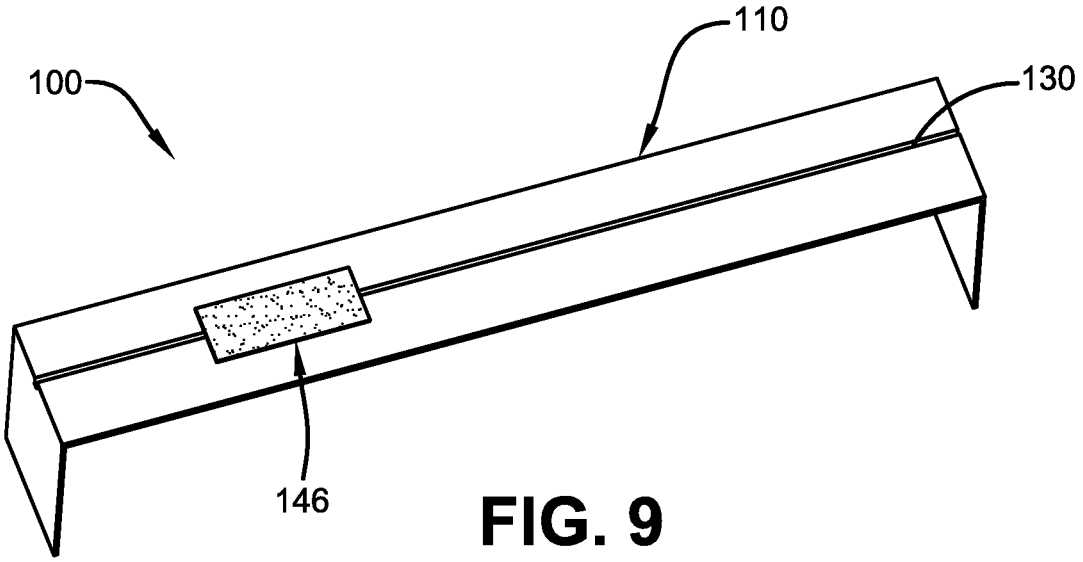
FIG. 9 illustrates a perspective view of the blocking bag mounting structure of the cornhole training apparatus of the present invention in accordance with the disclosed architecture.
Figure 10:
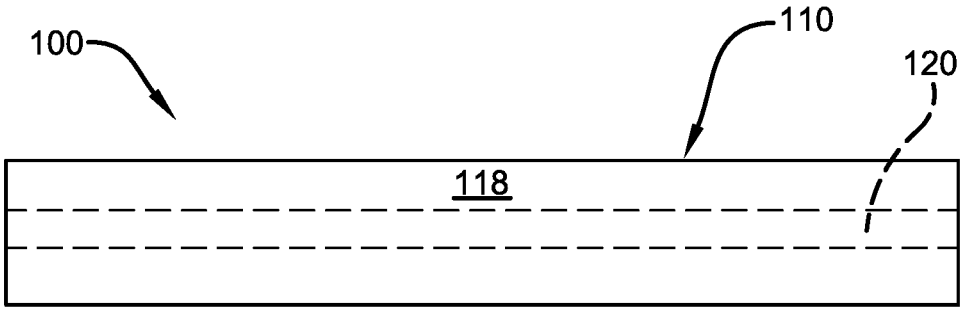
FIG. 10 illustrates an underneath view of the blocking bag mounting structure of the cornhole training apparatus of the present invention in accordance with the disclosed architecture.
Figure 11:
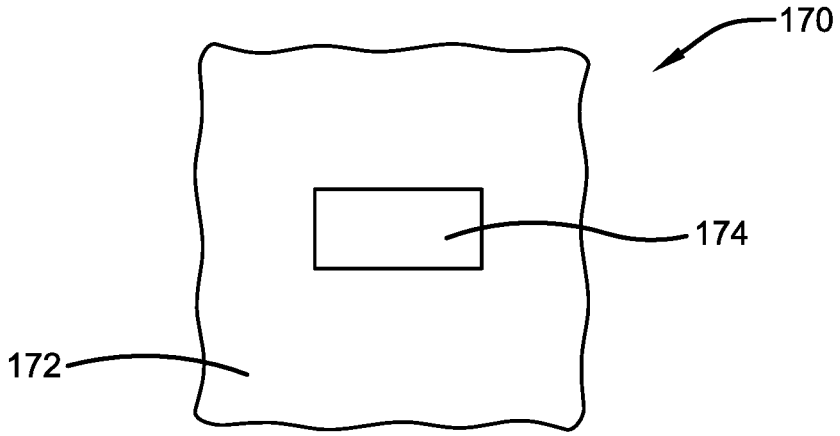
FIG. 11 illustrates a bottom view of the blocking bag of the cornhole training apparatus of the present invention in accordance with the disclosed architecture.

In another embodiment illustrated in FIG. 9, the horizontal band 112 may further comprise a channel 130. The channel 130 is a small groove horizontally disposed in the top surface 112 of the horizontal band 112 that will not interfere with a tossed bag sliding across the surface. The channel 130 is configured to accept the mounting structure engaging portion 178 of the at least one blocking bag 170 allowing the blocking bag 170 to slide to different positions side to side along the horizontal band 112.

Figure 12:
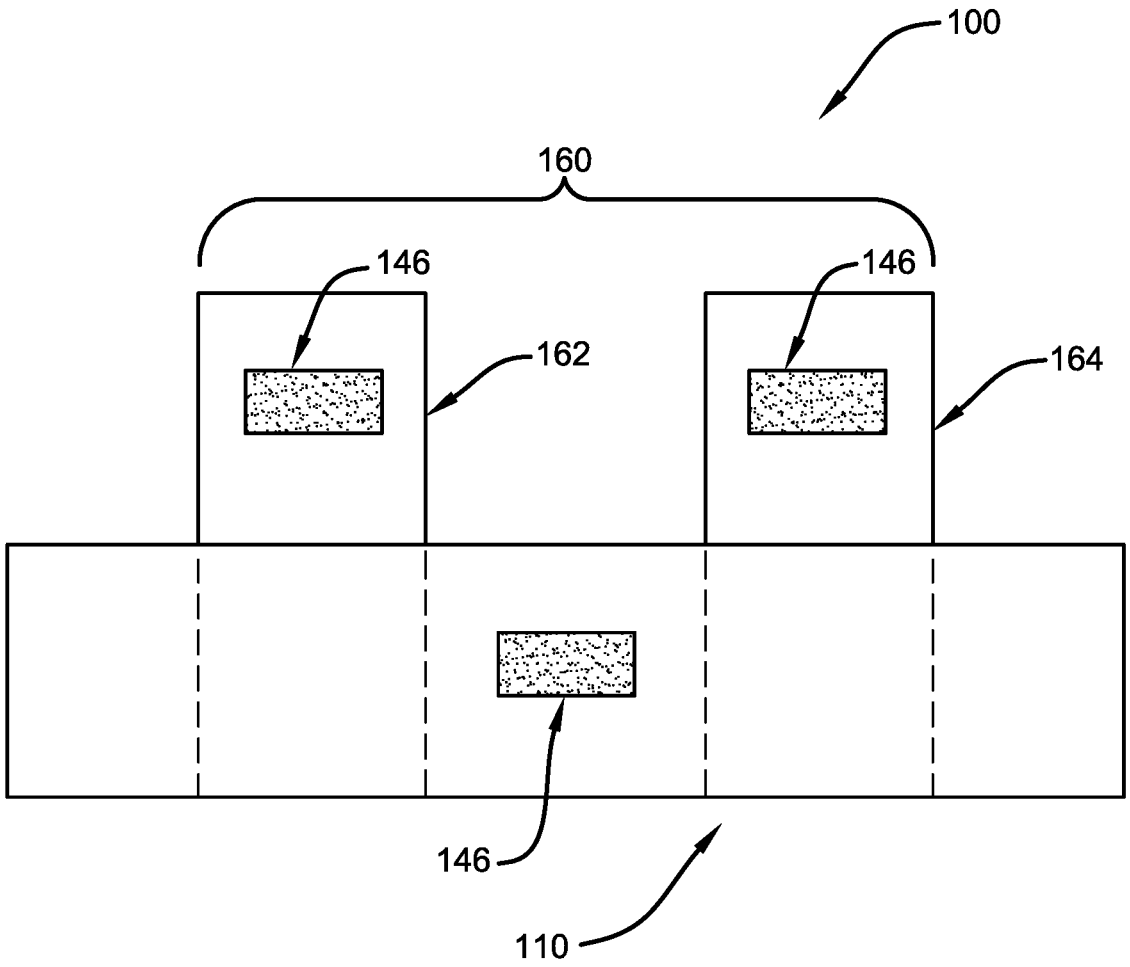
FIG. 12 illustrates a top view of a blocking bag mounting structure comprising a vertical structure of the cornhole training apparatus of the present invention in accordance with the disclosed architecture.

In another embodiment illustrated in FIG. 12, the blocking bag mounting structure 110 further comprises a vertical structure 160. The vertical structure extends perpendicularly from the horizontal band 112. The vertical structure 160 comprises a first vertical extension 162. The first vertical extension 162 extends upward from the horizontal band 112 on one side of the circular aperture 30 of the cornhole board 10. One of the plurality of blocking bag attachment elements 146 may be attached to the first vertical extension 162 to position one of the blocking bags 170 next to the circular aperture 30.

The vertical structure 160 may comprises a second vertical extension 164. The second vertical extension 164 may extends upward from the horizontal band 112 on the opposite side of the circular aperture 30 of the cornhole board 10 from the first vertical extension 162. One of the plurality of blocking bag attachment elements 146 may be attached to the second vertical extension 164 to position one of the blocking bags 170 next to the circular aperture 30. The first and second vertical extensions 162 and 164 are generally parallel to each other and are separated by at least six inches to accommodate the circular aperture 30. This orientation is advantageous as it allows the user to simulate practice scenarios where multiple bags are positioned at different points around the circular aperture 30.

Notwithstanding the foregoing, the cornhole training apparatus 100 can be any suitable size, shape, and configuration as is known in the art without affecting the overall concept of the invention, provided that it accomplishes the above stated objectives. One of ordinary skill in the art will appreciate that the shape and size of the cornhole training apparatus 100 and its various components, as show in the FIGS. are for illustrative purposes only, and that many other shapes and sizes of cornhole training apparatus 100 are well within the scope of the present disclosure. Although dimensions of cornhole training apparatus 100 and its components (i.e., length, width, and height) are important design parameters for good performance, cornhole training apparatus 100 and its various components may be any shape or size that ensures optimal performance during use and/or that suits user need and/or preference. As such, cornhole training apparatus 100 may be comprised of sizing/shaping that is appropriate and specific in regard to whatever cornhole training apparatus 100 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A cornhole training apparatus comprising:

a blocking bag mounting structure comprising a horizontal band, a pair of cornhole board engaging members oppositely disposed at either end of the horizontal band; and a blocking bag attachment element attached to a top side of the horizontal band, and a blocking bag comprising a cornhole bag and a mounting structure engaging component attached to the cornhole bag, the mounting structure engaging component attachable to the blocking bag attachment element of the top side of the horizontal band; and wherein the pair of cornhole board engaging members are configured to engage a cornhole gameboard holding the horizontal band in place on a top surface of the cornhole gameboard.

2. The cornhole training apparatus of claim 1, wherein the blocking bag attachment element comprises a horizontal band attachment portion and a blocking bag engaging portion.

3. The cornhole training apparatus of claim 2, wherein the blocking bag engaging portion is a hook and loop fastening system.

4. The cornhole training apparatus of claim 2, wherein the horizontal band attachment portion is attached to the horizontal band via an adhesive or a mechanical fastener.

5. The cornhole training apparatus of claim 1, wherein a blocking bag attachment position is centered on the horizontal band between the pair of cornhole board engaging members.

6. The cornhole training apparatus of claim 1, wherein the pair of cornhole board engaging members frictionally engage the cornhole gameboard.

7. The cornhole training apparatus of claim 1, wherein the pair of cornhole board engaging members are flexible.

8. The cornhole training apparatus of claim 1, wherein each cornhole board engaging member comprises a side grip portion.

9. The cornhole training apparatus of claim 8, wherein each cornhole board engaging member further comprises an underside grip portion extending from the side grip portion.

10. A cornhole training apparatus adapted for use with a cornhole gameboard, the cornhole training apparatus comprising:

a blocking bag mounting structure comprising a horizontal band, a pair of cornhole board engaging members oppositely disposed at either end of the horizontal band, and a blocking bag attachment element attached to a top side of the horizontal band; and a blocking bag comprising a cornhole bag and a mounting structure engaging component attached to the cornhole bag, the blocking bag attachable to the blocking bag attachment element; and wherein the pair of cornhole board engaging members are configured to engage a cornhole gameboard holding the horizontal band in place on a top surface of the cornhole gameboard.

11. The cornhole training apparatus of claim 10, wherein the horizontal band comprises a magnetic element.

12. The cornhole training apparatus of claim 10, wherein the horizontal band comprises a channel horizontally disposed in a top surface of the horizontal band.

13. The cornhole training apparatus of claim 10, wherein the blocking bag attachment element is re-positional along the horizontal band.

14. The cornhole training apparatus of claim 10, wherein the mounting structure engaging component comprises a mounting structure engaging portion.

15. The cornhole training apparatus of claim 10 further comprising a second blocking bag attachment element attached to the top side of the horizontal band and a second blocking bag.

16. A cornhole training apparatus adapted for use with a cornhole gameboard, the cornhole training apparatus comprising:

a blocking bag mounting structure comprising a horizontal band, a pair of cornhole board engaging members oppositely disposed at either end of the horizontal band, a vertical structure extending perpendicularly from the horizontal band, and a blocking bag attachment element attached to a top side of the horizontal band; and at least one blocking bag comprising a cornhole bag and a mounting structure engaging component attached to the cornhole bag, the at least one blocking bag attachable to the horizontal band; and wherein the pair of cornhole board engaging members are configured to engage a cornhole gameboard holding the horizontal band in place on a top surface of the cornhole gameboard.

17. The cornhole training apparatus of claim 16, wherein the vertical structure comprises a first vertical extension and a second vertical extension parallel to each other separated by at least six inches.

* * * * *